United States Patent [19]

Tominaga et al.

[11] 4,360,390

[45] Nov. 23, 1982

[54] METHOD FOR DIRECT HEAT TREATING AUSTENITIC STAINLESS STEEL WIRE ROD

[75] Inventors: Jiro Tominaga; Wataru Shinada; Wataru Murata; Masahiro Ito, all of Hikari, Japan

[73] Assignee: Nippon Steel Corporation, Tokyo, Japan

[21] Appl. No.: 184,325

[22] Filed: Sep. 5, 1980

[30] Foreign Application Priority Data

Sep. 6, 1979 [JP] Japan ..... 54/113563

[51] Int. Cl.[3] ..... C21D 8/06

[52] U.S. Cl. ..... 148/12 B; 148/12.4

[58] Field of Search ..... 148/12 B, 12 E, 38, 148/12.4

[56] References Cited

U.S. PATENT DOCUMENTS 3,917,493 11/1975 Mimino et al. ..... 148/12 E 3,969,161 7/1976 Mimino et al. ..... 148/38

FOREIGN PATENT DOCUMENTS 52-70925 6/1977 Japan ..... 148/12 B 52-70926 6/1977 Japan ..... 148/12 B

*Primary Examiner*—Peter K. Skiff

*Attorney, Agent, or Firm*—Wenderoth, Lind & Ponack

[57] ABSTRACT

Method for direct heat treating austenitic stainless steel wire rod wherein a hot rolled austenitic stainless steel wire rod is rendered to finish the final finishing stand of a hot rolling mill at a temperature zone in the range of solution heat treatment, then the temperature zone of said solution heat treatment is so maintained that the austenitic crystal grain size is to be less than 7.0, and subsequently said wire rod is quenched to a temperature where no chromium carbide is precipitated at a cooling rate where no chromium carbide is precipitated.

3 Claims, 7 Drawing Figures

METHOD FOR DIRECT HEAT TREATING AUSTENITIC STAINLESS STEEL WIRE ROD

BACKGROUND OF THE INVENTION

1. Field of the Invention

The present invention relates to method for the direct heat treating an austenitic stainless steel wire rod. An object is to provide a method for direct heat treating an austenitic stainless steel wire rod suitable for further cold working by utilizing the retained heat of a hot rolled austenitic stainless steel wire rod emerging from the final finishing stand of a hot rolling mill.

2. Description of the Prior Art

The invention stems from an observed fact as follows. A conventional austenitic stainless steel wire rod produced by the hot rolling process is available for extensive use in various fields, such as, in making nails, rivets, wire nets, and other miscellaneous small parts. In accordance with a particular use, the wire rod is subjected to further cold working, such as, wire drawing to a desired size.

The common wire rod is manufactured by the steps of hot rolling, reeling into a coil form, and cooling, but the wire rod thus manufactured as such has so fine a crystal grain that its strength is too high to be suitable for further cold working. Further, chromium carbide precipitates on the crystal grain boundary, which may cause corrosion. Accordingly, a hot rolled austenitic stainless steel wire rod is usually heated at a temperature of 1050°–1100° C. so as to grow the crystal grains to a suitable degree, and subjected to a so-called solution heat treatment in which chromium carbide is soluble in the matrix and then quenched, and further, subjected to cold working.

Japan Open-laid Pat. No. SHO50-96419(1975) discloses the above so-called direct heat treatment of a wire rod in which the solution heat treatment described above is conducted on the rod by taking advantage of the retained heat of the rod, which has just emerged from hot rolling. The method of this disclosure comprises the steps of reheating the wire rod having a temperature of about 1000° C. which has just emerged from the final finishing stand of the hot rolling mill to a solution heat treatment temperature in a reheating furnace equipped before or after a reeler, and then quenching it. However, this method needs reheating, so let us say that a conventional solution heat treatment arrangement is simply installed at the rear of a hot rolling line. In other words, reheating for a relatively extended period of time is required in order to grow the crystal grains of the wire rod for the purpose of imparting excellent cold working properties, therefore beneficial and gratifying effects cannot be expected.

SUMMARY OF THE INVENTION

Briefly stated, this invention comprises a series of steps which involve the final finishing hot rolling of an austenitic stainless steel wire rod at a temperature solution heat treatment zone temperature, maintaining the temperature zone of the solution heat treatment so as to render the austenite crystal grain size number to be less than 7.0 as determined by JIS (Japan Industrial Standard) G0551, and quenching it to a temperature and at a cooling rate where no chromium carbide precipitates. In other words, in this invention, the wire rod, after the final finishing hot rolling at the solution heat treatment zone temperature is maintained in such manner that the austenite crystal grain is rendered to grow appropriately, and subsequently quenched so as not to precipitate chromium carbide.

Accordingly, it is an object of the invention to provide a method for manufacturing an austenitic stainless steel wire rod having excellent cold working properties, such as, wire drawing by means of a direct heat treating process with inexpensive equipment and with little consumption of energy.

It is another object of the invention to provide an austenitic stainless steel wire rod having an austenite crystal grain size less than 7.0 of the grain size number as determined by JIS G0551, preferably between 3.0–7.0 by the novel method of heat treatment of this invention, whereby the cold working, such as, wire drawing of the wire rod is much improved.

It is still another object of the invention to provide a novel method for the direct heat treating of an austenitic stainless steel wire rod while it is still at the high temperature emerging from the final finishing hot rolling of the wire rod at the ever increasing high speed of the hot rolling mill. By this method, the retained heat of the wire rod is positively utilized so that the final finishing hot rolling is finished at the temperature of the solution heat treatment zone whereby the austenite crystal grains are produced, suitable for the subsequent cold working.

It is another object of this invention to provide an austenitic stainless steel wire rod of excellent quality in which the austenite crystal grain size is properly grown. Further, the precipitation of chromium carbide during quenching is so inhibited that the deterioration of the corrosion resistance in the region of chromium depletion is prevented due to the precipitation of said chromium carbide.

The novel characteristic features of the invention are set forth in particular in the following specification and in the appended claims. The improved method will be best understood upon perusal of the following detailed description of the specific embodiment with reference to the accompanying drawings.

BRIEF DESCRIPTION OF THE DRAWINGS

FIGS. 3–7 are diagrammatic views showing the equipment used in the embodiments of this invention, in which:

FIGS. 3–4 are diagrammatic views showing equipment of the present invention used for slow and gradual cooling, FIGS. 5–6 are diagrammatic views showing certain equipment used for holding, and FIG. 7 is a diagrammatic view of equipment for carrying out the solution heat treatment on a continuous non-concentric overlapping wire rod ring deposited on a conveyor.

DETAILED DESCRIPTION OF THE INVENTION

Since solution treatment of austenitic stainless steel is commonly carried out at a temperature of above 1050°

C., it is required that the finishing hot rolling step should be finished at above 1050° C., preferably above 1100° C. In recent days, the hot rolling of the wire rod tends to be highly accelerated, and much higher temperatures of the finishing hot rolling are accompanied therewith. In this invention, the high temperature is positively utilized to finish the finishing hot rolling at the temperature zone of the solution treatment. For the purpose of finishing the finishing hot rolling at high temperatures, in addition to the high speed hot rolling, the temperature of heating the billet is performed much higher prior to hot rolling and the provision of induction heating equipment between rolling stands of a rolling mill can be used.

As means for maintaining the temperature of hot rolled wire rod after the finishing hot rolling at the temperature of solution treatment, are provided means for growing the austenite crystal grain by controlling the cooling rate for the wire rod in a cooling rate control furnace arranged before or after a reeler; means for passing the wire rod through a holding furnace maintained at a definite temperature in the range of temperature zones of solution treatment, and combined means for achieving the above can be utilized.

The austenite crystal grain size is so grown that it is less than the grain size number 7.0 by holding the hot rolled wire rod at the temperature of solution treatment by the above means. If the crystal grain size is smaller than the number 7.0, the strength of the steel is so high that it is troublesome in cold working, such as, wire drawing. Besides, if the crystal grain grows too coarse disadvantages occur, such as, skin defects in cold working, hence the grain size number is preferably maintained between 3.0–7.0.

After the grain size has been properly grown by maintaining the wire rod at the temperature of solution treatment, it is quenched so as not to precipitate chromium carbide in the course of cooling. If chromium carbide should precipitate in cooling, the region of chromium depletion occurs in the vicinity of the precipitated chromium with the result that corrosion resistance deteriorates. The temperature where the precipitation of chromium carbide occurs is usually at a temperature of about 500°–700° C., hence it is preferred to quench the wire rod to a temperature of above 800° C. to below 500° C. The method of quenching depends on the diameter of the wire rod and the density of the coil of wire rod ring, and it is properly preferred. Any cooling rate, such as, of conventional air-blast quenching, by mist, or water can be used as desired.

An embodiment of the invention will be described in detail in the following description with reference to the drawings.

Figure 1:
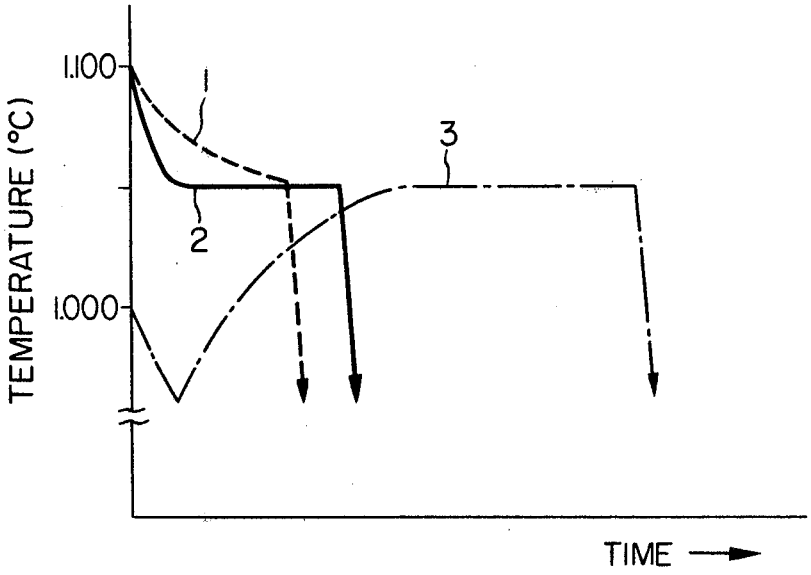
FIG. 1 is a diagrammatic graphic view showing a comparison of the heat treatment pattern for the purpose of obtaining the same crystal grain size as that of an austenitic stainless steel wire rod produced by a conventional method.

FIG. 1 is a graphic diagram showing two heat treatments, one being the heat treatment of this invention and another that of the known method in comparison. Graph 1 shows an embodiment of this invention wherein the wire rod emerging from the finishing hot rolling at a temperature of 1100° C. is slowly cooled to the temperature of 1050° C. near to the lower limit of the temperature of solution treatment, and subsequently quenched. Graph 2 is also another embodiment of the invention wherein the rod at the temperature of 1100° C. from the finishing hot rolling is held at the temperature of 1050° C. in the course of cooling from 1100° C., and then quenched. Graph 3 shows a known method of prior art as disclosed in Japan Open-laid Pat. No. SHO50-96419 wherein reheating is carried out.

As described above, in accordance with the method of this invention, the temperature of finishing hot rolling lies in the range of temperature of solution treatment, and the hot rolled wire rod is held at the temperature range without being cooled below the temperature of solution treatment in order to grow the proper austenite crystal grains, hence the solution treatment is feasible for a period of short time as compared with the conventional known method.

Figure 2:
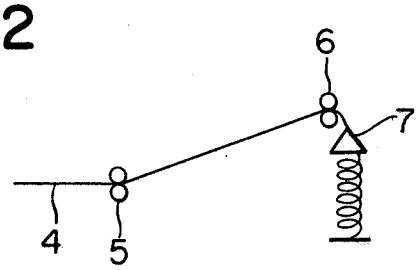
FIG. 2 shows a diagrammatic system of hot rolling a wire rod.

FIG. 2 is a known hot rolling system of rolling a wire rod which has been heretofore carried out. As is well known, the wire rod 4 passes the final finishing hot rolling stand 5 of a hot rolling mill, then passes a pinch roll 6, then it is reeled into a coil form by a reeler 7, and then cooled in the air. In this known method, the austenite crystal grains grows slowly, and chromium carbide precipitates in the grain boundary. As the thus produced wire rod has inferior cold working properties, the solution heat treatment is indispensable for secondary or subsequent cold working, such as, wire drawing.

Figure 3:
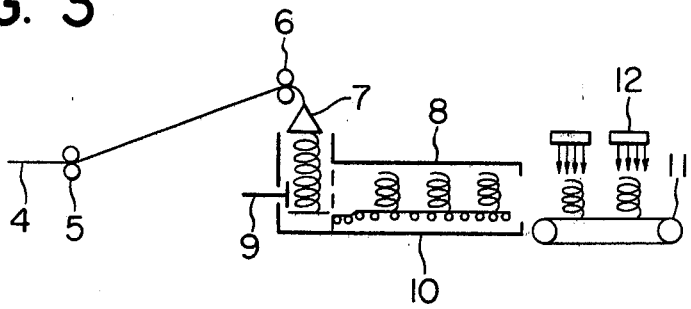
Figure 4:
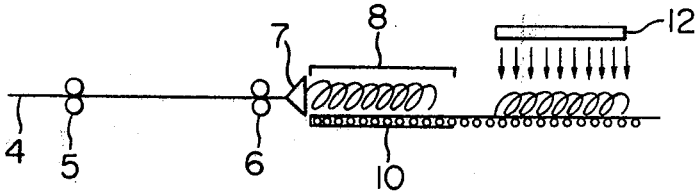
Figure 5:
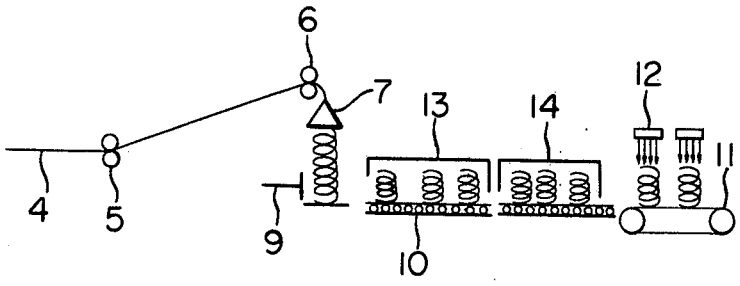
Figure 6:
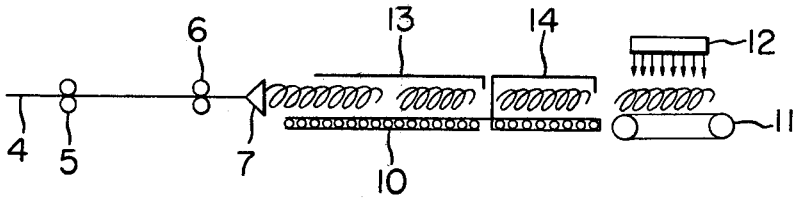

FIGS. 3–7 show equipment for carrying out the invention, more particularly, FIGS. 3–4 show equipment for embodying the slow cooling method while FIGS. 5–6 show suitable equipment for maintaining the holding temperature.

In FIG. 3, the wire rod 4 issuing from the final finishing stand 5 of the hot rolling mill at a high temperature above 1100° C. is reeled by a reeler 7 as such, and delivered by a pusher 9 to a cooling rate controller 8. Within the cooling rate controller 8, the coil of rod travels on a conveyor 10 continuously. After the coil has been cooled at a specified cooling rate, it moves on a cooling conveyor 11 on which it is quenched by quenching means 12.

In the method of FIG. 4, the high temperature wire, rod which has passed the reeler 7, is reeled into a continuous non-concentric overlapping loop form to move on the conveyor 10 directly connected to the cooling rate controller 8, and subsequently it is quenched by the quenching means 12.

In FIG. 5, the coil of wire rod reeled at high temperature is rapidly transferred to a holding furnace 14 where the coil is held for a period of specified time, then transferred to a cooling conveyor 11, and subsequently quenched by the quenching means 12. It is preferred that an adiabatic cover 13 be arranged between reeler 7 and holding furnace 14 in order to prevent the temperature of the wire rod from being lowered below 1050° C.

In accordance with an embodiment of the invention in FIG. 6, the wire rod is reeled into the continuous non-concentric overlapping loop form on the conveyor 10, the rod coil passes the adiabatic cover 13, then moves to the holding furnace 14, and subsequently quenched by the quenching means 12.

Figure 7:
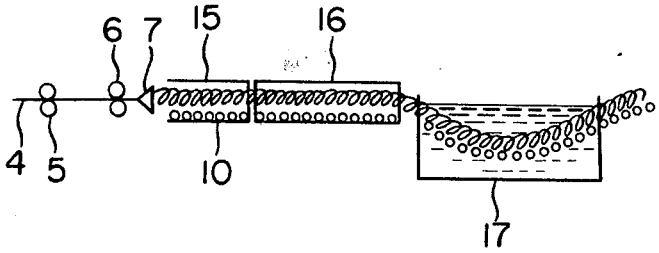

In FIG. 7, the wire rod is developed as a continuous non-concentric overlapping loop form on the conveyor 10 and subjected to the solution heat treatment while the rod loop is being continuously transferred on the conveyor 10. This method can be applied to any of the slow cooling method shown in FIG. 4 or of the holding method in FIG. 6.

In carrying out a gradual and slow cooling, the cooling rate is controlled by the combined use of cover 15 and furnace 16 or by the furnace 16. In holding, the cover 15 is replaced by the adiabatic cover and the furnace is used as the holding furnace. The rod subjected to the gradual and slow cooling or to holding is quenched in a quenching tank 17. The cooling media in FIGS. 3–6 can use any of water and air-blast or both together, and the salt bath can be applied, too, in the method of FIG. 7.

In addition, in the embodiments in FIGS. 5–7, the adiabatic cover 13 is not required so long as the temperature of the wire rod is not lowered below 1050° C.

In the following examples, the requirement of treatment and the mechanical properties of SUS (stands for stainless steel according to the notation of JIS) 304 wire rod, 5.5 mm diameter, of the chemical analysis listed in Table 1 are shown in Table 2.

TABLE 1

| Chemical Analysis (% by wt.) | | | | | | |
|---|---|---|---|---|---|---|
| C | Si | Mn | P | S | Ni | Cr |
| 0.072 | 0.48 | 1.20 | 0.032 | 0.004 | 8.53 | 18.15 |

Nos. 9–16 refer to examples of conventional known methods of direct heat treatment. No. 17 refers to an example in which the conventional hot rolled wire rod is subjected to the solution treatment on an off-line and this method has been heretofore carried out in general as shown in FIG. 2 while No. 18 refers to an example where no solution treatment is done.

As it is clearly shown in Table 2, the austenitic stainless steel wire rod manufactured in accordance with the present invention has the same qualities as that of the wire rod subjected to the solution treatment which has been heretofore conducted in general.

On the contrary, in accordance with the conventional example in which the temperature of the final finishing hot rolling is so low that the solution treatment is carried out by reheating, it must be heated for a relatively extended time period in order to obtain a crystal grain size of less than 7.0, hence it is not feasible for the direct heat treatment, because it takes much time till the temperature of the wire rod reaches the temperature of solution treatment.

TABLE 2

Examples, SUS304 5.5 mmϕ

| No | Finishing hot rolling temperature (°C.) | Cooling rate till 1050° C. (°C./sec.) | Holding temperature (°C.) | Holding time (min.) | Microscopic structure: Grain size | Microscopic structure: Cr carbide | Mechanical properties: Tensile strength (kg/mm²) | Mechanical properties: Reduction of area (%) | Mechanical properties: Hardness (Hv/kg) | Wire drawing limit (mmϕ) | Remarks |
|---|---|---|---|---|---|---|---|---|---|---|---|
| 1 | 1090 | 0.61 | — | — | 5.4 | no | 58 | 79 | 145 | 1.80 | 66 sec. till 1050° C. |
| 2 | 1115 | 0.33 | — | — | 4.8 | " | 53 | 80 | 140 | " | 200 sec. till 1050° C. |
| 3 | 1205 | 1.8 | — | — | 5.3 | " | 55 | 80 | 143 | " | 85 sec. till 1050° C. |
| 4 | 1220 | 1.2 | — | — | 4.4 | " | 51 | 82 | 138 | " | 140 sec. till 1050° C. |
| 5 | 1120 | — | 1055 | 2 | 5.6 | " | 58 | 79 | 148 | " | Examples of |
| 6 | " | — | " | 5 | 4.9 | " | 56 | 80 | 145 | " | this invention |
| 7 | " | — | 1100 | 2 | 5.0 | " | 52 | 81 | 143 | " | |
| 8 | " | — | " | 3 | 4.7 | " | 53 | 82 | 140 | " | |
| 9 | 900 | — | 1050 | 5(reheating time) | 7.8 | " | 68 | 77 | 162 | 2.50 | Conventional examples (Solution treatment on-line |
| 10 | " | — | " | 10(reheating time) | 6.5 | " | 65 | 77 | 160 | " | |
| 11 | " | — | 1100 | 5(reheating time) | 7.5 | " | 68 | 76 | 163 | " | |
| 12 | " | — | " | 10(reheating time) | 5.9 | " | 58 | 79 | 147 | 2.25 | |
| 13 | 1000 | — | 1050 | 5(reheating time) | 7.5 | " | 67 | 75 | 161 | 2.50 | |
| 14 | " | — | " | 10(reheating time) | 6.3 | " | 64 | 73 | 158 | " | |
| 15 | " | — | 1100 | 5(reheating time) | 7.3 | " | 67 | 76 | 160 | " | |
| 16 | " | — | " | 10(reheating time) | 5.2 | " | 56 | 80 | 145 | 2.25 | |
| 17 | 900–1000 | — | 1050 | 60(reheating time) | 4.8 | " | 54 | 82 | 143 | 1.80 | Conventional examples (solution treatment off-line) |
| 18 | " | — | — | — | 10.2 | precipitate | 70 | 75 | 170 | 3.20 | No solution treatment |

Note:
Austenite crystal grain size number is as determined by JIS G0551 (1977).
Wire drawing limit is shown by the rod diameter where it is broken or defect occurs when it is drawn step by step as follows:
Wire rod of 5.5 mmϕ → 4.95 → 4.45 → 3.95 → 3.55 → 3.20 → 2.85 → 2.50 → 2.25 → 2.00 → 1.80 mmϕ

Referring more particularly to Table 2, examples Nos. 1–8 refer to those of this invention in which Nos. 1–4 refer to those comprising subjecting wire rods to the final finishing hot rolling, and subsequently to the gradual and slow cooling at the temperature zone of solution treatment while Nos. 5–8 refer to those comprising holding the wire rod at a definite temperature in the range of the temperatures of solution treatment.

As fully described in the foregoing, in accordance with the novel method of this invention, the austenitic stainless steel wire rod can be subjected to the solution treatment so as to obtain the desired crystal grain size continuously on the hot rolling line for a short period of time with the result that a wire rod of excellent cold working properties equal to that of a wire rod subjected to a solution treatment by means of reheating on an off-line can be produced.

Although the present invention has been described and diagrammatically shown in connection with the preferred embodiments, it is to be understood that modifications may be resorted to without departing from the spirit of the invention. Such modifications are considered to be within the scope of the present invention as defined by the appended claims.

What is claimed is:

1. A method for directly heat treating an austenitic stainless steel wire rod which consists essentially of the steps of subjecting the wire rod to a finish hot rolling at a temperature suitable for the solution treatment of the wire rod, maintaining the wire rod from the final finish hot rolling step at a temperature within the solution treatment zone until the austenite crystal grain size number of the wire rod is in the range of 3.0 to 7.0 as determined by the JIS G0551 test, and subsequently quenching said wire rod at a rate and temperature below about 500° C., so that substantially no chromium carbide precipitation takes place, thereby producing an austenitic stainless steel wire rod having good cold working properties, such that the reduction of area percentage is at least about 79%.

2. A method as claimed in claim 1, wherein the final finishing hot rolling is completed at a temperature of at least 1100° C.

3. A method as claimed in claim 1, wherein said wire rod is maintained at a temperature of at least 1050° C., taking advantage of the retained heat of said wire rod resulting from said final finishing hot rolling, until the austenite crystal grain size number is in the range of 3.0–7.0, and subsequently quenching the wire rod from 1050° C. to a temperature below 500° C.

* * * * *